US010267539B2

(12) United States Patent
Sishtla

(10) Patent No.: US 10,267,539 B2
(45) Date of Patent: Apr. 23, 2019

(54) HOT GAS BYPASS FOR TWO-STAGE COMPRESSOR

(71) Applicant: Carrier Corporation, Jupiter, FL (US)

(72) Inventor: Vishnu M. Sishtla, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 230 days.

(21) Appl. No.: 15/117,012

(22) PCT Filed: Jan. 20, 2015

(86) PCT No.: PCT/US2015/011940
§ 371 (c)(1),
(2) Date: Aug. 5, 2016

(87) PCT Pub. No.: WO2015/122991
PCT Pub. Date: Aug. 20, 2015

(65) Prior Publication Data

US 2017/0176053 A1 Jun. 22, 2017

Related U.S. Application Data

(60) Provisional application No. 61/940,716, filed on Feb. 17, 2014.

(51) Int. Cl.
*F25B 1/10* (2006.01)
*F04D 17/12* (2006.01)
(Continued)

(52) U.S. Cl.
CPC ..... *F25B 1/10* (2013.01); *F04D 17/122* (2013.01); *F04D 27/0215* (2013.01);
(Continued)

(58) Field of Classification Search
CPC .... F25B 1/10; F25B 1/053; F25B 2400/0403; F25B 2400/0411; F04D 17/122;
(Continued)

(56) References Cited

U.S. PATENT DOCUMENTS 5,980,218 A 11/1999 Takahashi et al.
6,079,952 A 6/2000 Harte et al.
(Continued)

FOREIGN PATENT DOCUMENTS

CA 2099989 C 3/2000
CN 1464964 A 12/2003
(Continued)

OTHER PUBLICATIONS

International Search Report and Written Opinion for PCT/US2015/011940, dated Oct. 13, 2015.
(Continued)

*Primary Examiner* — Henry T Crenshaw
(74) *Attorney, Agent, or Firm* — Bachman & LaPointe, P.C.

(57) ABSTRACT

A vapor compression system comprising a centrifugal compressor (22) having: an inlet (24); an outlet (26); a first impeller stage (28); a second impeller stage (30); and a motor (34) coupled to the first impeller stage and second impeller stage. A first heat exchanger (38) is downstream of the outlet along a refrigerant flowpath. An expansion device (56) and a second heat exchanger (64) are upstream of the inlet along the refrigerant flowpath. A bypass flowpath (120; 320) is positioned to deliver refrigerant from the compressor bypassing the first heat exchanger. A valve (128) is positioned to control flow through the bypass flowpath, wherein: the bypass flowpath extends from a first location (140) intermediate the inlet and outlet to a second location (142; 342) downstream of the first heat exchanger along the refrigerant flowpath.

17 Claims, 5 Drawing Sheets

(51) Int. Cl.

| | |
|---|---|
| ***F25B 1/053*** | (2006.01) |
| ***F25B 49/02*** | (2006.01) |
| ***F04D 29/44*** | (2006.01) |
| ***F25B 41/04*** | (2006.01) |
| *F04D 27/02* | (2006.01) |

(52) U.S. Cl.
CPC ..... *F04D 27/0223* (2013.01); *F04D 29/441* (2013.01); *F25B 1/053* (2013.01); *F25B 41/04* (2013.01); *F25B 49/02* (2013.01); *F04D 27/023* (2013.01); *F04D 27/0238* (2013.01); *F25B 2400/0403* (2013.01); *F25B 2400/0411* (2013.01); *F25B 2400/13* (2013.01); *F25B 2400/23* (2013.01); *F25B 2600/17* (2013.01); *F25B 2600/2501* (2013.01); *F25B 2700/151* (2013.01); *F25B 2700/195* (2013.01); *F25B 2700/197* (2013.01); *F25B 2700/1931* (2013.01)

(58) Field of Classification Search
CPC ..... F04D 27/0215; F04D 27/0223; F04D 27/023; F04D 27/0238; F04D 29/441
USPC ..... 62/197
See application file for complete search history.

(56) References Cited

U.S. PATENT DOCUMENTS

| | | | | |
|---|---|---|---|---|
| 7,665,973 | B2 | 2/2010 | Hwang | |
| 8,037,702 | B2 | 10/2011 | Sato et al. | |
| 8,567,207 | B2 | 10/2013 | Sommer et al. | |
| 8,591,199 | B2 | 11/2013 | Martinez et al. | |
| 2003/0094007 | A1* | 5/2003 | Choi | F25B 1/053 62/197 |
| 2003/0188544 | A1 | 10/2003 | Yamasaki et al. | |
| 2006/0010908 | A1* | 1/2006 | Taras | F24F 3/153 62/513 |
| 2010/0057263 | A1* | 3/2010 | Tutunoglu | F24F 11/0086 700/282 |
| 2012/0011866 | A1* | 1/2012 | Scarcella | F25B 1/10 62/79 |
| 2012/0261092 | A1 | 10/2012 | Heath et al. | |
| 2013/0025306 | A1* | 1/2013 | Matsukura | F25B 41/04 62/115 |
| 2013/0061613 | A1* | 3/2013 | Rached | C09K 5/045 62/77 |
| 2013/0219929 | A1* | 8/2013 | Kontomaris | C09K 5/045 62/77 |
| 2014/0208785 | A1* | 7/2014 | Wallace | F25B 9/008 62/115 |
| 2014/0326018 | A1* | 11/2014 | Ignatiev | F25B 49/02 62/510 |
| 2016/0272047 | A1* | 9/2016 | Gan | B60H 1/3223 |
| 2017/0176053 | A1* | 6/2017 | Sishtla | F04D 29/441 |

FOREIGN PATENT DOCUMENTS

| | | | |
|---|---|---|---|
| CN | 102388279 | A | 3/2012 |
| CN | 103477161 | A | 12/2013 |
| DE | 102013201482 | B3 | 10/2013 |
| EP | 1923553 | A2 | 5/2008 |
| EP | 2497955 | A1 | 9/2012 |
| EP | 2677252 | A1 | 12/2013 |
| JP | 2012202336 | A | 10/2012 |
| WO | 2006050434 | A2 | 5/2006 |
| WO | 2009056987 | A2 | 5/2009 |
| WO | 2010117973 | A2 | 10/2010 |
| WO | 2010144255 | A1 | 12/2010 |
| WO | 2012117599 | A1 | 9/2012 |
| WO | 2012145156 | A1 | 10/2012 |
| WO | 2012166858 | A1 | 12/2012 |

OTHER PUBLICATIONS

Chinese Office action dated Apr. 16, 2018 for Chinese Patent Application No. 201580008844.3.

* cited by examiner

HOT GAS BYPASS FOR TWO-STAGE COMPRESSOR

CROSS-REFERENCE TO RELATED APPLICATION

Benefit is claimed of U.S. Patent Application Ser. No. 61/940,716, filed Feb. 17, 2014, and entitled "HOT GAS BYPASS FOR TWO-STAGE COMPRESSOR", the disclosure of which is incorporated by reference herein in its entirety as if set forth at length.

BACKGROUND

The disclosure relates to vapor compression systems. More particularly, the disclosure relates to surge control of multi-stage centrifugal compressors in vapor compression systems.

One example of a vapor compression system involves a chiller. The exemplary chiller involves a two-stage centrifugal compressor driven by an electric motor. The main refrigerant flowpath through the exemplary system passes sequentially from an outlet of the compressor through a condenser, an economizer (e.g., a flash tank economizer), an expansion device, and a cooler, returning from the cooler to the compressor inlet. An economizer line may extend from the economizer to an interstage of the compressor.

The exemplary prior art chiller uses a hot gas bypass to provide stable operation at low loads. The exemplary bypass is from discharge conditions (e.g., between the compressor outlet and condenser inlet) to cooler inlet conditions (e.g., downstream of the expansion device). Flow along the bypass flowpath is governed by a hot gas bypass valve, in turn controlled by a system controller. When compressor load falls below a set level, the exemplary controller opens the bypass valve. This causes an increase of load to the compressor resulting in stable operation.

SUMMARY

One aspect of the disclosure involves a vapor compression system comprising a centrifugal compressor having: an inlet; an outlet; a first impeller stage; a second impeller stage; and a motor coupled to the first impeller stage and second impeller stage. A first heat exchanger is downstream of the outlet along a refrigerant flowpath. An expansion device and a second heat exchanger are upstream of the inlet along the refrigerant flowpath. A bypass flowpath is positioned to deliver refrigerant from the compressor bypassing the first heat exchanger. A valve is positioned to control flow through the bypass flowpath. The bypass flowpath extends from a first location intermediate the inlet and outlet to a second location downstream of the first heat exchanger along the refrigerant flowpath.

In one or more embodiments of any of the foregoing embodiments, the second location is downstream of the expansion device along the refrigerant flowpath.

In one or more embodiments of any of the foregoing embodiments, the second location is upstream of the second heat exchanger along the refrigerant flowpath.

In one or more embodiments of any of the foregoing embodiments, the bypass flowpath is a first bypass flowpath and a second bypass flowpath extends from a third location between the first location downstream of the first location to a fourth location upstream of the expansion device.

In one or more embodiments of any of the foregoing embodiments, the fourth location is downstream of the first heat exchanger.

In one or more embodiments of any of the foregoing embodiments, the fourth location is on an economizer tank.

In one or more embodiments of any of the foregoing embodiments, the system further comprises an economizer having an economizer line returning to a fifth location intermediate the inlet and outlet.

In one or more embodiments of any of the foregoing embodiments, the system further comprises an economizer having an economizer line returning to an economizer port intermediate the inlet and outlet.

In one or more embodiments of any of the foregoing embodiments, the economizer port and the first location are at an interstage.

In one or more embodiments of any of the foregoing embodiments, the system further comprises a controller configured to: calculate at least one pressure parameter; and responsive to the calculated pressure parameter, control flow along the bypass flowpath.

In one or more embodiments of any of the foregoing embodiments, a method for using the system comprises: driving rotation of the first impeller and the second impeller; measuring at least one pressure; calculating at least one pressure parameter; and responsive to the calculated pressure parameter, controlling flow along the bypass flowpath.

In one or more embodiments of any of the foregoing embodiments, the calculating comprises a difference over time.

In one or more embodiments of any of the foregoing embodiments, the calculating comprises an average over time.

Another aspect of the disclosure is a vapor compression system comprising a centrifugal compressor having: an inlet; an outlet; a first impeller stage; a second impeller stage; and a motor coupled to the first impeller stage and second impeller stage. A first heat exchanger is downstream of the outlet along a refrigerant flowpath. An economizer is downstream of the first heat exchanger along the refrigerant flowpath. An economizer line returns from the economizer to the compressor. An expansion device and a second heat exchanger are upstream of the outlet along a refrigerant flowpath. A bypass flowpath is positioned to deliver refrigerant from the compressor bypassing the first heat exchanger. A valve is positioned to control flow through the bypass flowpath. The bypass flowpath extends from a first location to a second location downstream of the first heat exchanger but at or upstream of the economizer along the refrigerant flowpath.

In one or more embodiments of any of the foregoing embodiments, the second location is at the economizer.

In one or more embodiments of any of the foregoing embodiments, the economizer is a flash tank economizer.

In one or more embodiments of any of the foregoing embodiments, the system further comprises a controller configured to: calculate at least one pressure parameter; and responsive to the calculated pressure parameter, control flow along the bypass flowpath.

In one or more embodiments of any of the foregoing embodiments, the system is a chiller system.

Another aspect of the disclosure involves a vapor compression system comprising a centrifugal compressor having: an inlet; an outlet; a first impeller stage; a second impeller stage; and a motor coupled to the first impeller stage and second impeller stage. A first heat exchanger is downstream of the outlet along a refrigerant flowpath. An expansion device and a second heat exchanger are upstream of the inlet along the refrigerant flowpath. A bypass flowpath is positioned to deliver refrigerant from the compressor bypassing the first heat exchanger. A valve is positioned to control flow through the bypass flowpath. The bypass flowpath is a first bypass flowpath. A second bypass flowpath extends at least partially non-overlapping with the first bypass flowpath.

In one or more embodiments of any of the foregoing embodiments, the system further comprises a controller configured to: calculate at least one pressure parameter; and responsive to the calculated pressure parameter, control flow along the bypass flowpath.

In one or more embodiments of any of the foregoing embodiments, a method for operating the system comprises: guiding rotation of the first impeller and the second impeller; opening the valve to permit flow through the first bypass flowpath; and opening a second valve to allow flow along the second bypass flowpath, flow along the second bypass flowpath proceeding to the second impeller stage bypassing the first impeller stage.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
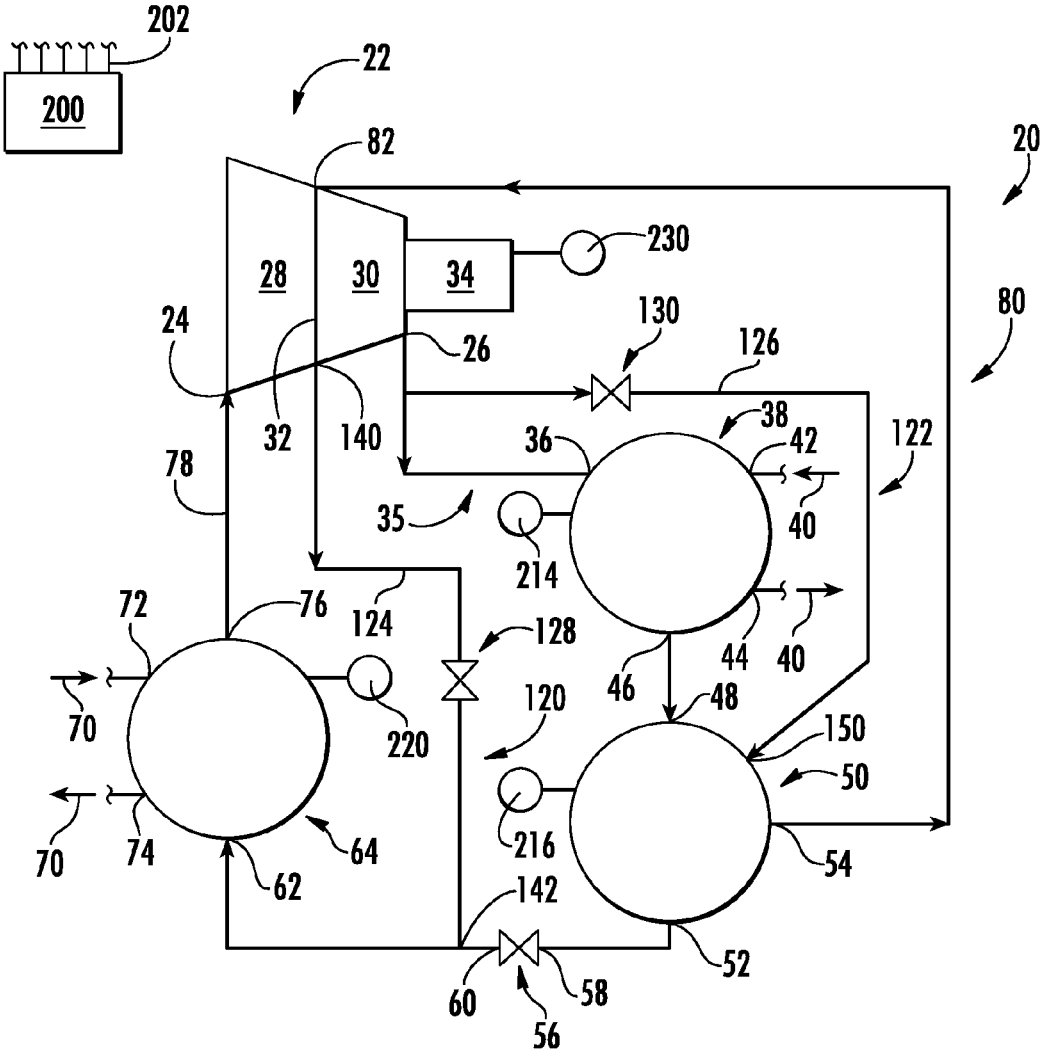
FIG. 1 is a schematic view of a chiller system.

FIG. 1 shows a vapor compression system 20 having an improved hot gas bypass configuration and operation. The exemplary vapor compression system 20 is a chiller used to cool a flow of water or other heat transfer liquid. The chiller comprises a compressor 22 having an inlet 24 defining suction conditions and an outlet 26 defining discharge conditions. An exemplary compressor is a two-stage centrifugal compressor having a first stage shown as 28, a second stage shown as 30, and an interstage shown as 32. Each stage comprises a centrifugal impeller. The two impellers are co-driven by an electric motor 34 (e.g., directly or via a gearbox). The system 20 has a main refrigerant flowpath 35 proceeding through the stages of compression between the inlet 24 and the outlet 26 and proceeding downstream via a discharge line from the outlet 26 to the inlet 36 of a heat exchanger 38. In normal operation, the heat exchanger 38 is a heat rejection heat exchanger, more particularly a condenser rejecting heat from the refrigerant flowing therethrough to an external flow of a heat transfer fluid. An exemplary flow of heat transfer fluid is cooling water or air. An exemplary flow 40 of heat transfer fluid enters an inlet 42 of the condenser 38 and exits an outlet 44 (e.g., a water loop of the heat exchanger). The refrigerant flow exits a refrigerant outlet 46 of the condenser and is passed to an inlet 48 of an economizer 50.

The exemplary economizer is a flash tank economizer having a liquid outlet 52 and a vapor outlet 54. The liquid outlet 52 is along the main refrigerant flowpath 35 which proceeds further downstream to an expansion device 56 having an inlet 58 and an outlet 60. The main refrigerant flowpath 35 passes further downstream from the expansion device outlet 60 to an inlet 62 of a second heat exchanger (a heat absorption heat exchanger (e.g., cooler)) 64. The cooler absorbs heat from a flow 70 of heat transfer fluid (e.g., water) entering an inlet 72 and exiting an outlet 74 (e.g., a water loop of the heat exchanger). The cooler has a refrigerant outlet 76 along the main refrigerant flowpath with a suction line 78 connecting the outlet 76 to the compressor inlet 24 to complete the main refrigerant flowpath 35. An economizer line 80 defines an economizer flowpath extending from the vapor outlet 54 back to the compressor. In an exemplary embodiment, the economizer flowpath extends to an economizer port 82 intermediate the inlet 24 and outlet 26 (more particularly, at the interstage in this example). As so far described, this is representative of one of several exemplary prior art configurations to which one or more of the further modifications may be applied.

Relative to known hot gas bypass configurations, one example has several differences. First, instead of a single hot gas bypass flowpath, there are two at least partially non-overlapping hot gas bypass flowpaths 120 and 122 departing from and returning to the main refrigerant flowpath. Each hot gas bypass flowpath 120,122 is largely defined/bounded by an associated hot gas bypass line 124, 126 in which a hot gas bypass valve 128, 130 is located to control flow along the associated hot gas bypass flowpath. Additionally, the location of one end of each bypass flowpath 120, 122 is shifted relative to the baseline described above.

The first hot gas bypass flowpath 120 extends from an upstream end at a port 140 on the compressor to a downstream end at a location 142 between the expansion device 56 and the cooler 64. The location 142 may be the same as the aforementioned prior art location. The exemplary location 140, however, is not at discharge conditions but rather at an intermediate condition such as at an interstage. More broadly, the intermediate condition of the port 140 may represent somewhere between 20% and 80% of the compression process by the compressor.

The second hot gas bypass flowpath 122 may extend from discharge conditions as does the aforementioned prior art hot gas bypass flowpath. However, the exemplary second hot gas bypass flowpath 122 extends to a location 150 upstream of the expansion device 56. In the illustrated example, the location 150 is along the economizer 50.

Figure 2:
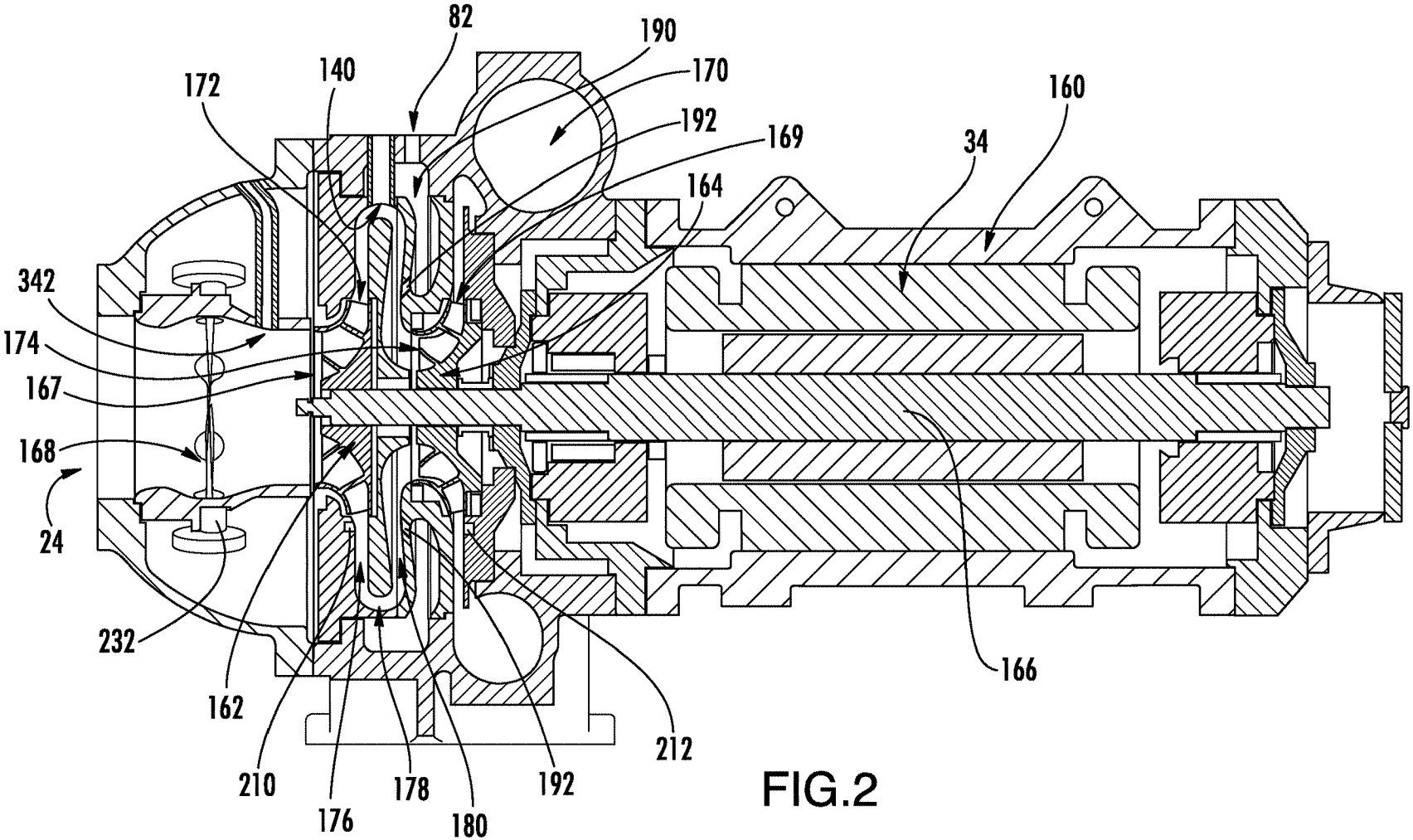
FIG. 2 is a partially schematic view of a compressor of the system of FIG. 1.

FIG. 2 schematically shows exemplary locations of the economizer port 82, port 140, and impeller stages. It further shows a case (housing) assembly 160 of the compressor containing the first stage impeller 162 and the second stage impeller 164 mounted to the shaft 166 of the motor 34. Between the inlet 24 and the inlet 167 of the first stage impeller, the case contains a controllable inlet guide vane (IGV) array 168. downstream of the second stage impeller outlet 169, the case defines a discharge plenum 170 along which the discharge port (not shown) is located. Between the outlet 172 of the first stage impeller and the inlet 174 of the second stage impeller, components of the housing assembly define one or more passageways including diffuser passageways 176 extending radially outward to a turn 178 which turns back radially inward and joins with return passageways (return) 180 extending radially inward and then turning axially to meet the inlet 174. The exemplary location of port 140 is along the turn 178. More broadly, the exemplary location of port 140 is along or downstream of the diffuser.

The exemplary economizer port 82 feeds an economizer gas chamber 190 to in turn introduce gas to the primary refrigerant flowpath via injection ports 192. Exemplary injections ports are along the return 180.

FIG. 1 further shows a controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines 202 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Figure 3:
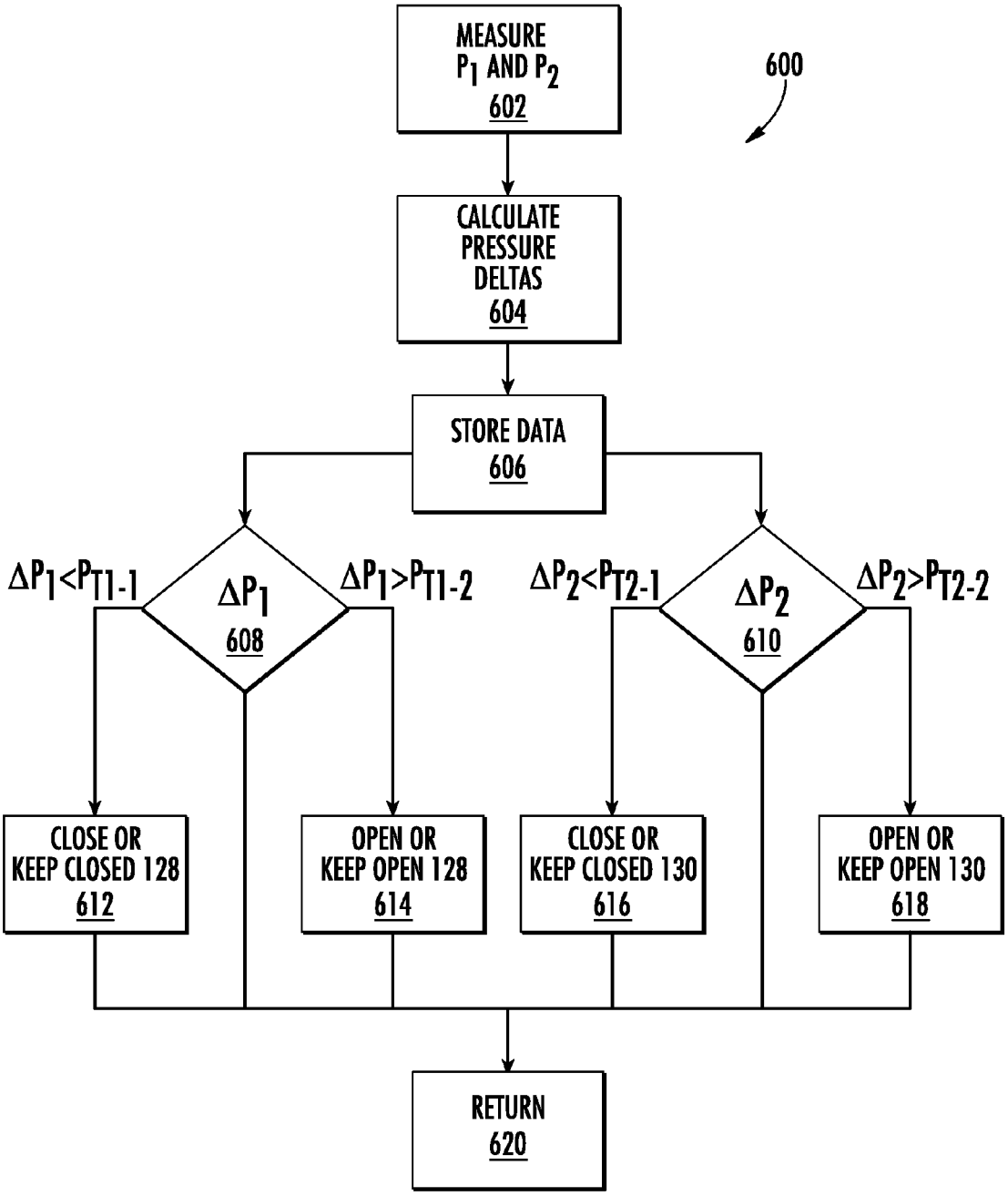
FIG. 3 is a flowchart of a portion of an operation algorithm involving control of hot gas bypass.

FIG. 3 shows a control routine which may be programmed or otherwise configured into the controller. The routine provides limitation of surge and may be superimposed upon the controller's normal programming/routines (not shown, e.g., providing the basic operation of a baseline system to which the foregoing control routine is added). The exemplary control routine uses input from a series of pressure sensors including sensor 210 at the first stage impeller exit, sensor 212 at the second stage impeller exit, 214 at the condenser, 216 at the economizer and 220 at the cooler. A motor current sensor 230 and inlet guide vane position sensor 232 also provide input to the controller.

In the exemplary routine 600 of FIG. 3, pressure characteristics of the two stages are respectively measured 602. In this example, a pressure $P_1$ for the first stage is measured by the sensor 210 and a pressure $P_2$ for the second stage is measured by the sensor 212. Changes to each of these pressures are calculated 604. Exemplary changes or Δs ($\Delta P_1$ and $\Delta P_2$, respectively) are the two measured pressure values relative to the corresponding previously-measured values in a cyclic process. The new pressure data may be stored 606 for use in the next cycle. The two pressure Δs are then compared 608, 610 to reference or threshold values. In this example, if $\Delta P_1$ is less than a first associated threshold pressure $P_{T1\text{-}1}$, the associated bypass valve is closed or is kept closed 612. In this example, the associated bypasses along the bypass flowpath 120 and the closing is the closing of the valve 128. Similarly, if $\Delta P_1$ is greater than an associated threshold value $P_{T1\text{-}2}$, the associated bypass flowpath 120 and valve 128 are opened or kept open 614. Similarly, if $\Delta P_2$ is less than an associated threshold $P_{T2\text{-}1}$, the associated bypass flowpath 122 and the valve 130 are closed or kept closed. If $\Delta P_2$ is greater than a second associated threshold value $P_{T2\text{-}2}$, then the bypass flowpath 122 and valve 130 are opened or kept open 618. A return step 620 returns to the beginning after a preset delay and repeats. The exemplary cycle rate for the process is one minute. The exemplary values of $P_{T1\text{-}2}$ and $P_{T2\text{-}2}$ are 5 psi (34 kPa). Exemplary $P_{T1\text{-}1}$ and $P_{T2\text{-}1}$, are 2.0 psi (14 kPa).

Figure 4:
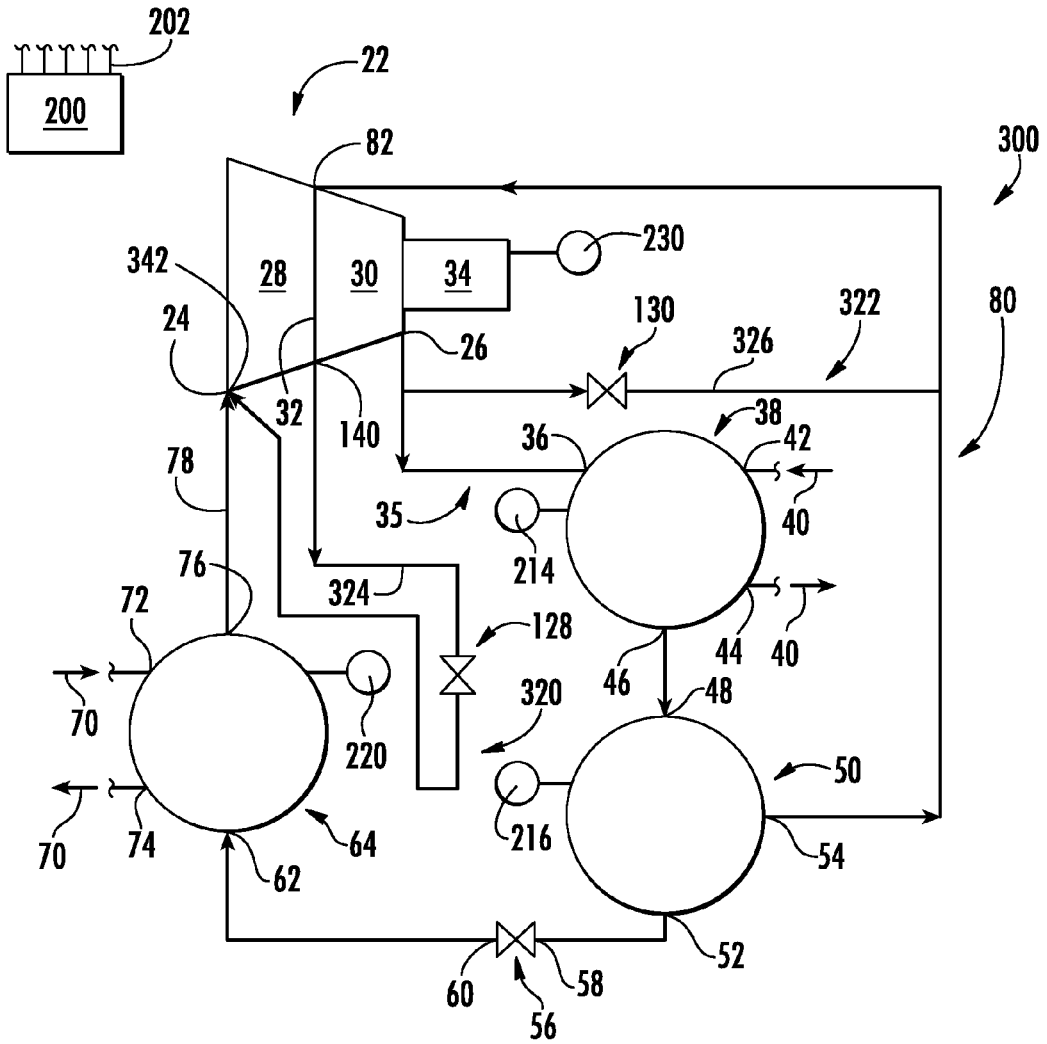
FIG. 4 is a schematic view of a second chiller system.

FIG. 4 shows an alternate system 300 which may be otherwise similar to the system 20 in structure and operation but has changes to one or both bypass flowpaths. First, there is a redirected return of the first bypass flowpath 320 and line 324 relative to the flowpath 120 and line 124. In this case, rather than returning to a location between the expansion device 56 and the heat absorption heat exchanger 64, the return is to a location 342 relatively downstream. The exemplary location 342 is downstream of the heat absorption heat exchanger 64. More particularly, the exemplary location 342 is the return downstream of the inlet guide vanes (shown added to FIG. 3).

The second exemplary change in the system 300 relative to the system 20 is the redirected return of the second bypass flowpath 322 and line 326 relative to the flowpath 120 and line 126. In this case, rather than returning to a location downstream of the heat rejection heat exchanger 38, the return to the primary flowpath is back to the compressor, more particularly, an intermediate location along the compressor. In the illustrated example the return is interstage, namely to the economizer port 82. This return may be achieved by simply joining the economizer flowpath 80 so as to overlap along the downstream portion of both such flowpath. By bypassing the economizer, with the flowpath 322, a reduction in economizer size may be facilitated.

Figure 5:
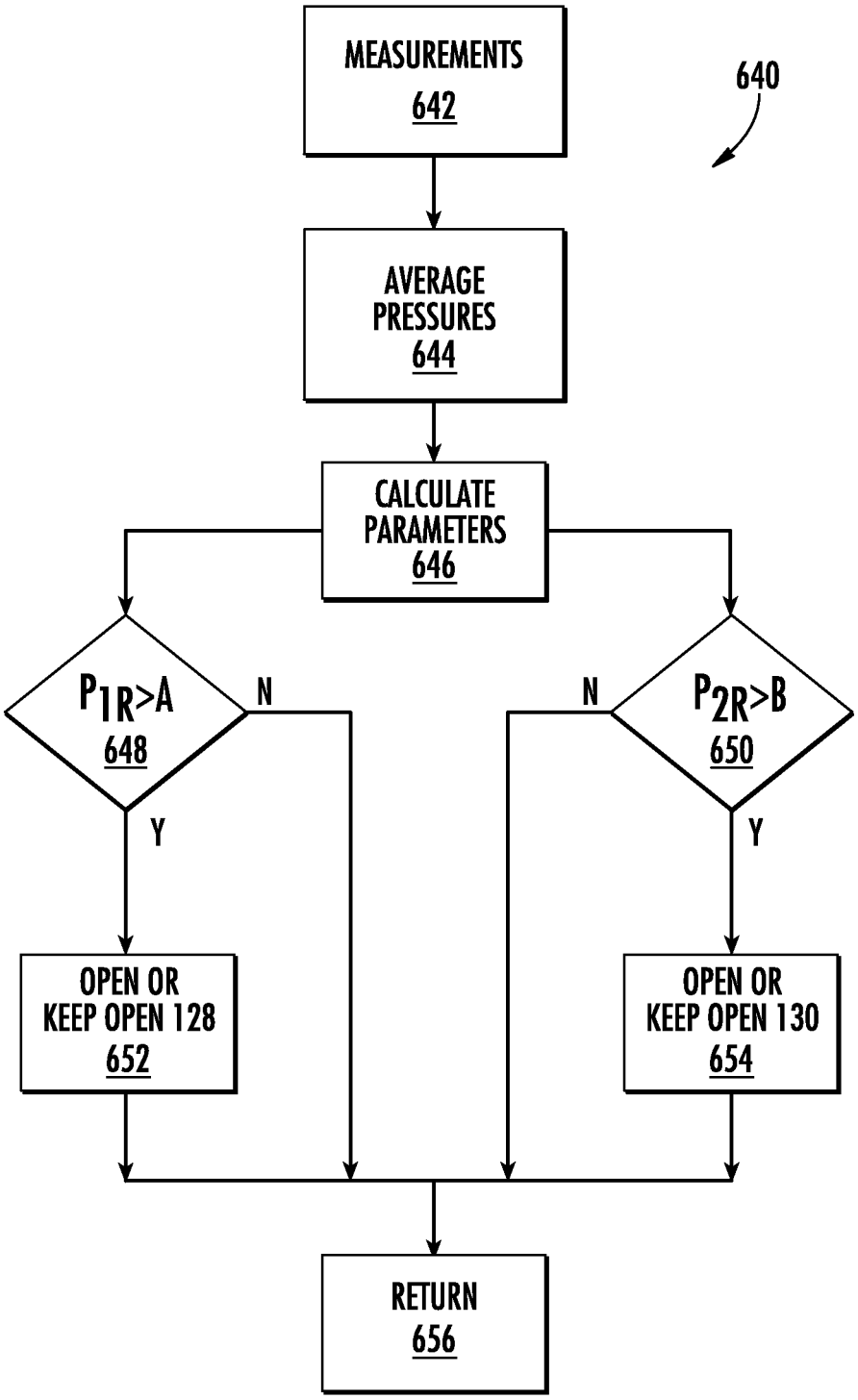
FIG. 5 is a flowchart of a portion of an operation algorithm involving controlled hot gas bypass.

FIG. 5 shows an exemplary control routine 640 for the system 300. In this example, the initial measurement step 642 measures not only $P_1$ and $P_2$ but also the condenser pressure $P_C$ (e.g., via sensor 214), the evaporator pressure $P_E$ (e.g., via sensor 220) and the inlet guide vane position (e.g., via sensor 232). Averages of $P_{1A}$ and $P_{2A}$ respectively, $P_1$ and $P_2$ are then calculated 644. The exemplary average is calculated as an average over a short interval such as 0.5 minute to 5 minutes (e.g., 1 minute). Two parameters are then calculated which are indicative of pre-surge. The exemplary parameter $P_{1R}$ is defined as $P_{1A}/P_E$. An exemplary parameter $P_{2R}$ is defined as $P_{2A}/P_C$. These two parameters are then evaluated 648, 650. If $P_{1R}$ is greater than a threshold value A then the bypass valve 128 is opened or kept open 652. If $P_{2R}$ is greater than a second threshold (optionally coincident with the first threshold) B then the bypass valve 130 is opened or kept open 654. Thereafter, a return 656 may return to the measurements 642.

The exemplary principles may be applied to other two-stage compressor configurations. For example, the system configurations may be applied to so-called back-to-back compressors where the two impeller stages are mounted at opposite ends of a motor shaft. When standing alone, the exemplary back-to-back compressor has opposite first and second inlets at opposite first and second ends and inlet guide vane arrays between such inlets and the respective inlets to the first and second stage impellers. A discharge plenum of the first stage impeller downstream of its diffuser is plumbed back to the second inlet when installed in the vapor compression system. The discharge plenum of the second stage feeds the overall compressor outlet with the first end inlet serving as the overall compressor inlet. The economizer flow may be directed interstage such as to a junction with the line connecting the first stage diffuser to the second end inlet upstream of the second end inlet guide vanes.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A vapor compression system (20; 300) comprising:

a centrifugal compressor (22) having:

an inlet (24);

an outlet (26);

a first impeller stage (28);

a second impeller stage (30); and a motor (34) coupled to the first impeller stage and second impeller stage;

a first heat exchanger (38) downstream of the outlet along a refrigerant flowpath;

an expansion device (56);

a second heat exchanger (64) upstream of the inlet along the refrigerant flowpath;

an economizer (50) having an economizer line (80) returning to an economizer port (82) intermediate the inlet and outlet;

a first bypass flowpath (120; 320) positioned to deliver refrigerant from the compressor bypassing the first heat exchanger; and a valve (128) positioned to control flow through the first bypass flowpath, wherein:

the first bypass flowpath extends from a first location (140) intermediate the inlet and outlet to a second location (142; 342) downstream of the first heat exchanger along the refrigerant flowpath; and a second bypass flowpath (122) extends from a third location downstream of the first location to a fourth location (150; 82) upstream of the expansion device, the fourth location at or upstream of the economizer.

2. The system of claim 1 wherein:

the second location (142; 342) is downstream of the expansion device along the refrigerant flowpath.

3. The system of claim 1 wherein:

the second location (142) is upstream of the second heat exchanger along the refrigerant flowpath.

4. The system of claim 1 wherein:

the fourth location (150) is downstream of the first heat exchanger.

5. The system of claim 1 wherein:

the fourth location is on a tank of the economizer.

6. The system of claim 1 wherein:

the economizer port and the first location are at an interstage (32).

7. The system of claim 1 further comprising a controller (200) configured to:

calculate at least one pressure parameter; and responsive to the calculated pressure parameter, control flow along the first bypass flowpath.

8. A method for using the system of claim 1, the method comprising:

driving rotation of the first impeller and the second impeller;

measuring at least one pressure;

calculating at least one pressure parameter; and responsive to the calculated pressure parameter, controlling flow along the first bypass flowpath.

9. A method for using a vapor compression system (20; 300), the vapor compression system comprising:

a centrifugal compressor (22) having:

an inlet (24);

an outlet (26);

a first impeller stage (28);

a second impeller stage (30); and a motor (34) coupled to the first impeller stage and second impeller stage;

a first heat exchanger (38) downstream of the outlet along a refrigerant flowpath;

an expansion device (56);

a second heat exchanger (64) upstream of the inlet along the refrigerant flowpath;

an economizer (50) having an economizer line (80) returning to an economizer port (82) intermediate the inlet and outlet;

a first bypass flowpath (120; 320) positioned to deliver refrigerant from the compressor bypassing the first heat exchanger; and a valve (128) positioned to control flow through the first bypass flowpath, wherein:

the first bypass flowpath extends from a first location (140) intermediate the inlet and outlet to a second location (142; 342) downstream of the first heat exchanger along the refrigerant flowpath; and a second bypass flowpath (122) extends from a third location downstream of the first location to a fourth location (150; 82) upstream of the expansion device, the method comprising:

driving rotation of the first impeller and the second impeller;

measuring at least one pressure;

calculating at least one pressure parameter, the calculating comprising a difference over time; and responsive to the calculated pressure parameter, controlling flow along the first bypass flowpath.

10. A method for using a vapor compression system (20; 300), the vapor compression system comprising:

a centrifugal compressor (22) having:

an inlet (24);

an outlet (26);

a first impeller stage (28);

a second impeller stage (30); and a motor (34) coupled to the first impeller stage and second impeller stage;

a first heat exchanger (38) downstream of the outlet along a refrigerant flowpath;

an expansion device (56);

a second heat exchanger (64) upstream of the inlet along the refrigerant flowpath;

an economizer (50) having an economizer line (80) returning to an economizer port (82) intermediate the inlet and outlet;

a first bypass flowpath (120; 320) positioned to deliver refrigerant from the compressor bypassing the first heat exchanger; and a valve (128) positioned to control flow through the first bypass flowpath, wherein:

the first bypass flowpath extends from a first location (140) intermediate the inlet and outlet to a second location (142; 342) downstream of the first heat exchanger along the refrigerant flowpath; and a second bypass flowpath (122) extends from a third location downstream of the first location to a fourth location (150; 82) upstream of the expansion device, the method comprising:

driving rotation of the first impeller and the second impeller;

measuring at least one pressure;

calculating at least one pressure parameter, the calculating comprising an average over time; and responsive to the calculated pressure parameter, controlling flow along the first bypass flowpath.

11. The system of claim 2 further comprising a controller configured to:

calculate at least one pressure parameter; and responsive to the calculated pressure parameter, control flow along the first bypass flowpath.

12. A method for operating the system of claim 1, the method comprising:

guiding rotation of the first impeller and the second impeller;

opening the valve to permit flow through the first bypass flowpath; and opening a second valve (130) to allow flow along the second bypass flowpath, flow along the second bypass flowpath proceeding to the second impeller stage bypassing the first impeller stage.

13. A vapor compression system (20; 300) comprising:

a centrifugal compressor (22) having:

an inlet (24);

an outlet (26);

a first impeller stage (28);

a second impeller stage (30); and a motor (34) coupled to the first impeller stage and second impeller stage;

a first heat exchanger (38) downstream of the outlet along a refrigerant flowpath;

an economizer (50) downstream of the first heat exchanger along the refrigerant flowpath;

an economizer line (80) returning from the economizer to the compressor;

an expansion device (56);

a second heat exchanger (64) upstream of the outlet along a refrigerant flowpath;

a bypass flowpath (122; 322) positioned to deliver refrigerant from the compressor bypassing the first heat exchanger; and a valve (130) positioned to control flow through the bypass flowpath, wherein:

the bypass flowpath extends from a first location to a second location downstream of the first heat exchanger but at or upstream of the economizer (150) along the refrigerant flowpath.

14. The system of claim 13 wherein:

the second location is at the economizer.

15. The system of claim 13 wherein:

the economizer is a flash tank economizer.

16. The system of claim 13 further comprising a controller configured to:

calculate at least one pressure parameter; and responsive to the calculated pressure parameter, control flow along the bypass flowpath.

17. The system of claim 13 wherein:

the system is a chiller system.

* * * * *